United States Patent [19]

Baxter

[11] 4,061,782

[45] Dec. 6, 1977

[54] BEVERAGE PACKAGE CUP

[75] Inventor: Gerald M. Baxter, Don Mills, Canada

[73] Assignee: Redimix Beverages Limited, Toronto, Canada

[21] Appl. No.: 753,114

[22] Filed: Dec. 22, 1976

Related U.S. Application Data

[63] Continuation-in-part of Ser. No. 580,609, May 27, 1975, abandoned.

[51] Int. Cl.[2] ..... B65B 29/06

[52] U.S. Cl. ..... 426/86; 206/217; 206/503; 206/508; 229/1.5 B; 426/115

[58] Field of Search ..... 426/86, 115; 206/217, 206/508, 503, 519, 520; 229/1.5 B

[56] References Cited

U.S. PATENT DOCUMENTS

| | | | |
|---|---|---|---|
| 1,889,111 | 11/1932 | Serr | 206/217 |
| 1,933,468 | 10/1933 | Abbot | 206/217 |
| 2,088,181 | 7/1937 | Swift, Jr. | 206/520 X |
| 3,186,850 | 6/1965 | Anthony | 426/86 |
| 3,561,664 | 2/1971 | Palmer | 229/1.5 B |
| 3,870,220 | 3/1975 | Koury et al. | 426/86 X |

FOREIGN PATENT DOCUMENTS

| | | | |
|---|---|---|---|
| 737,288 | 6/1966 | Canada | 426/86 |

*Primary Examiner*—Steven L. Weinstein
*Attorney, Agent, or Firm*—Rogers, Bereskin & Parr

[57] ABSTRACT

A beverage package cup is described. The cup includes a disposable drinking cup body having a lower portion containing a dry beverage ingredient. A removable cap hermetically seals the beverage ingredient in the lower portion of the cup body. The lower portion of the cup body also includes a plurality of inwardly directed internal lugs for preventing excessive inward displacement of a second cup stacked inside the first.

5 Claims, 8 Drawing Figures

BEVERAGE PACKAGE CUP

This application is a continuation-in-part of application Ser. No. 580,609 filed May 27, 1975, now abandoned.

This invention relates to disposable drinking cups containing pre-packed beverage ingredients to which water can be added to make a beverage. Cups of this kind are often referred to as beverage package cups.

In one type of prior art beverage package cup, the cup is fitted with a separate insert package containing the beverage ingredient. The package has a closure member which can be manually removed when water is to be added to the beverage ingredient. U.S. Pat. No. 3,561,664 (Palmer) discloses an example of a cup of this type. In another type of prior art cup, the beverage ingredient is disposed in the bottom of the cup itself and a rigid discform closure member is wedged into the cup to contain the beverage ingredient. Examples of this type of cup are shown in Canadian Pat. No. 737,288 (Newton) and U.S. Pat. No. 1,933,468 (Abbot).

A problem with prior art beverage package cups is that the beverage ingredients deteriorate quickly in the cups. As a result, prior art cups have been found unsuitable for use in vending machines and other situations in which the cups may have to be stored for some time. Also, in cups of the type having wedged-in closure members, the members are prone to accidental dislodgement which may result in spillage or even more rapid deterioration of the beverage ingredient. For example, cups of this type are normally stacked one within the other for storage. If the stack is accidentally compressed, the closure members are liable to be dislodged. If a cup is inadvertently squashed or otherwise radially compressed, the closure member may similarly be dislodged.

Cups of the type in which the beverage ingredient is contained in a separate insert package are less liable to accidental dislodgement of the closure member. However, it is found in practice that the insert package as a whole may be accidentally pulled out of the cup when the package closure member is removed. Also, cups of this type are substantially more expensive to manufacture than cups of the type having wedged-in closure members. A manufacturing problem encountered with the insert package type of cup is that the cup is often distorted when the package is fitted, with the result that the cup may leak in use. In any event, because of the problems encountered with both types of cup, conventional beverage package cups have not found wide public acceptance.

An object of the present invention is to provide an improved beverage package cup in which the beverage ingredient is protected against rapid deterioration.

According to the invention, there is provided a beverage package which includes a disposable drinking cup body having upper and lower portions of frusto-conical shape, and an outwardly directed annular flange disposed between and connecting said upper and lower portions. The lower portion of the cup includes a base and an upwardly-divergent side wall. The annular flange is inclined upwardly from said lower portion to said upper portion of the cup and defines an annular upper edge with said lower portion, and the upper portion also includes an upwardly-divergent side wall. A dry beverage ingredient is disposed in said lower portion of the cup body. A removable cap hermetically seals the beverage ingredient in said lower portion of the cup body. The cap includes a flexible closure portion which is at least substantially impervious to moisture. The closure portion has its peripheral margin hermetically sealed to said annular flange of the cup body and extends across the lower portion of the cup so as to protect the beverage ingredient from deterioration due to contact with ambient air and moisture. The cup also includes a pull-tab accessible from within said upper portion of the cup body and arranged so that the cap can be detached from said annular flange by pulling on the tab. The lower portion of the cup body additionally includes a plurality of inwardly directed internal lugs disposed at spaced positions around the side wall of the lower cup portion and each defining an upper end face disposed generally even with said annular upper edge of said portion and immediately below said cap so that, when a second similar cup is stacked inside the first, the said lugs support the second cup through the intermediary of the cup and thereby prevent excessive inward displacement of the second cup and pentration of the hermetic seal by dislodgement of the sealing cap.

In order that the invention may be more clearly understood, reference will now be made to the accompanying drawings which illustrate a number of embodiments of the invention. In the drawings.

Figure 1:
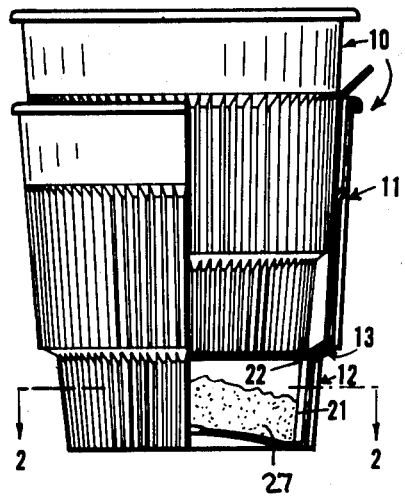
FIG. 1 is a side view of two beverage package cups, one of which is partly cut away.
Figure 5:
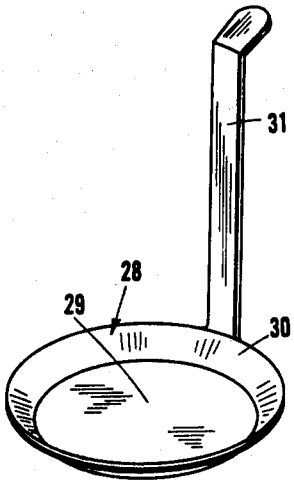
FIG. 5 is a perspective view of a sealing cap which may be used in the cups shown in FIG. 1.
Figure 2:
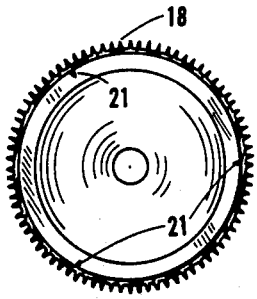
FIG. 2 is a transverse sectional view on line 2—2 of FIG. 1.

Referring first to FIG. 1, two beverage package cups, each generally denoted 10, are shown stacked one within the other. Each cup includes a cup body injection molded in a rigid polystyrene plastic material and includes upper and lower frusto-conical portions 11, 12 respectively joined together by an annular flange 13 disposed between the portions 11 and 12. The lower portion 12 includes a base 15 disposed in a plane 14 (FIG. 3), and an upwardly-divergent side wall 17. Annular flange 13 is inclined at an angle of about 30° to the plane 14. The side wall 17 of lower portion 12 is shaped to define a plurality of closely spaced external ribs 18. The base 15 of the lower portion 12 is of concave shape and includes a central raised portion 20 at the injection point of the mold in which the cup body is formed. A plurality of inwardly-directed lugs 21 are disposed at spaced positions around the side wall 17 of the lower portion 12 of the cup body. Each lug defines an upper end face 22 which is even with the top of wall 17. As can be seen from FIG. 2, three equally spaced lugs 21 are provided in this embodiment, although it is to be understood that there is no limitation to this number. The inner edges of the upper end faces 22 of the lugs 21 are disposed on a circle of effective diameter Ds less than the outside diameter Dc of the base of the lower portion of the cup.

The upper portion 11 of the cup body has an upwardly divergent side wall 23. A plurality of closely spaced ribs 24 extend around the lower part of side wall 23. The remainder of the side wall is plain, as indicated at 25 in FIG. 3, and terminates in an outwardly downturned rim 26 forming a lip for the cup body. The plain part of wall 23 is in fact of slightly larger diameter than the ribbed part of the wall so that the plain outer surface of part 25 is even with the longitudinal apexes of the ribs 24.

Figure 4:
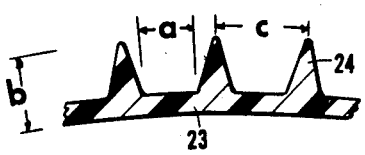
FIG. 4 is an enlarged sectional view on line 4—4 of FIG. 3.

FIG. 4 of the drawings shows the cross-sectional shape of the ribs 24; the ribs 18 of the lower part of the cup body are of similar shape. The purpose of the ribs 18 and 24 is to space the fingers of a person holding the cup from direct contact with the cup wall so that discomfort is minimized when the cup contains hot liquid. On this basis, it will be appreciated that the ribs 18 and 24 should preferably be spaced as closely as possible; in other words, dimension "*a*" in FIG. 4 should be a minimum. In this way, a maximum number of ribs can be provided. Also, the depth "*b*" of the ribs (measured from the inner surface of the cup wall) is preferably greater than the ridge-to-ridge distance "*c*" between adjacent ribs. In practice, it has been found preferable for the dimension "*b*" to be of the order of five to six times the thickness of the wall 23. This arrangement has been found sufficient to allow a user to hold a cup containing boiling water without significant discomfort.

The lower portion 12 of the cup body contains a quantity of dry beverage ingredient 27 which may be activated by adding water or other liquid. A sealing cap 28 is used to seal the ingredient 27 in the bottom portion 12 of the cup body. Cap 28 includes a disc-shaped central portion 29 surrounded by an inclined outwardly extending sealing flange 30. A pull-tab 31 extends outwardly from flange 30. A food-compatible adhesive such as polychloroprene latex adhesive embodying a tackifying resin is employed to seal the flange 30 of the cap to the annular flange 13 of the cup body, and thereby hermetically seal the ingredient 27 in the lower portion 12 of the cup. Cap 28 is made of a conventional laminate of cardpaper stock and aluminum foil (not shown) and includes a layer of a suitable plastic material such as a heavy grade polyethylene film or sheet.

Figure 6:
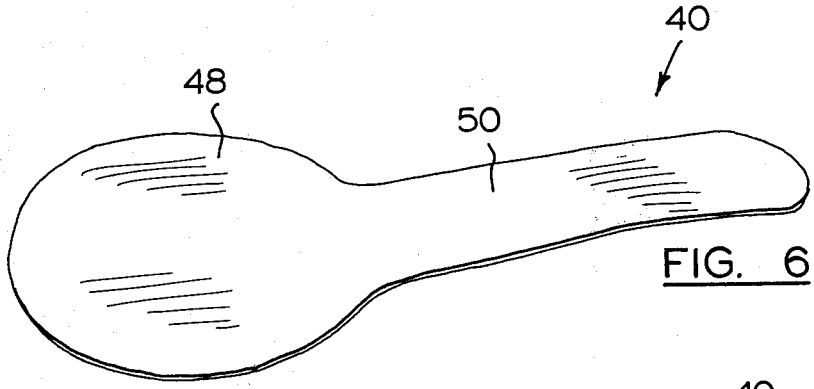
FIG. 6 is a perspective view of an alternative form of sealing cap.
Figure 7:
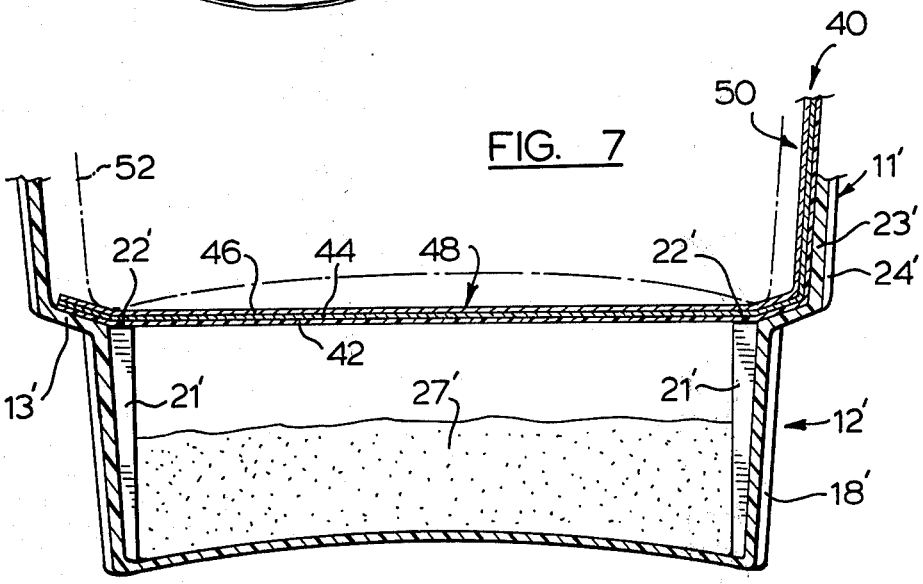
FIG. 7 is a vertical sectional view through the lower part of a cup fitted with the cap shown in FIG. 6; and, FIG. 8 is a perspective view of the cup of FIG. 7, partly broken away to show how the cap is removed.
Figure 8:
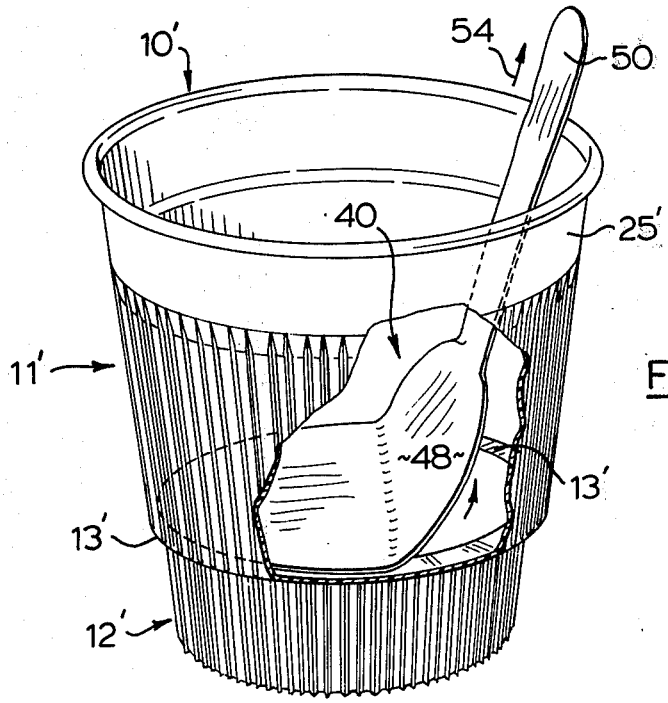

Reference will now be made to FIG. 6, 7 and 8 of the drawings in describing a preferred form of sealing cap. The cap is shown in perspective in FIG. 6 and is generally denoted by the reference numeral 40. As best shown in FIG. 7, the cap 40 is a three-layer laminate. The cap includes an inner layer on film 42 of polyethylene, an intermediate layer 44 of aluminum foil, and an outer layer 46 of paper. The structure of the cap is shown somewhat enlarged in FIG. 7. In practice, each of the three layers 42, 44 and 46 is relatively thin with the result that the cap overall is thin and flexible in nature. A laminate of the form described above is die-cut to the shape shown in FIG. 6. As can be seen, the cap defines a circular closure portion 48 and an elongate portion 50 which is integral with portion 48 and which forms a pull-tab. For convenience of manufacture, the whole of the cap including the pull-tab is of three-layer construction. The outer layer 46 will normally carry printed material indicating, for example, the nature of the beverage ingredient contained in the cup.

The cup body shown in FIGS. 7 and 8 is of the same form as that shown in FIGS. 1 to 4. Accordingly, primed reference numerals have been used in FIGS. 7 and 8 to denote parts which correspond with parts of the cup body of FIGS. 1 to 4.

Figure 3:
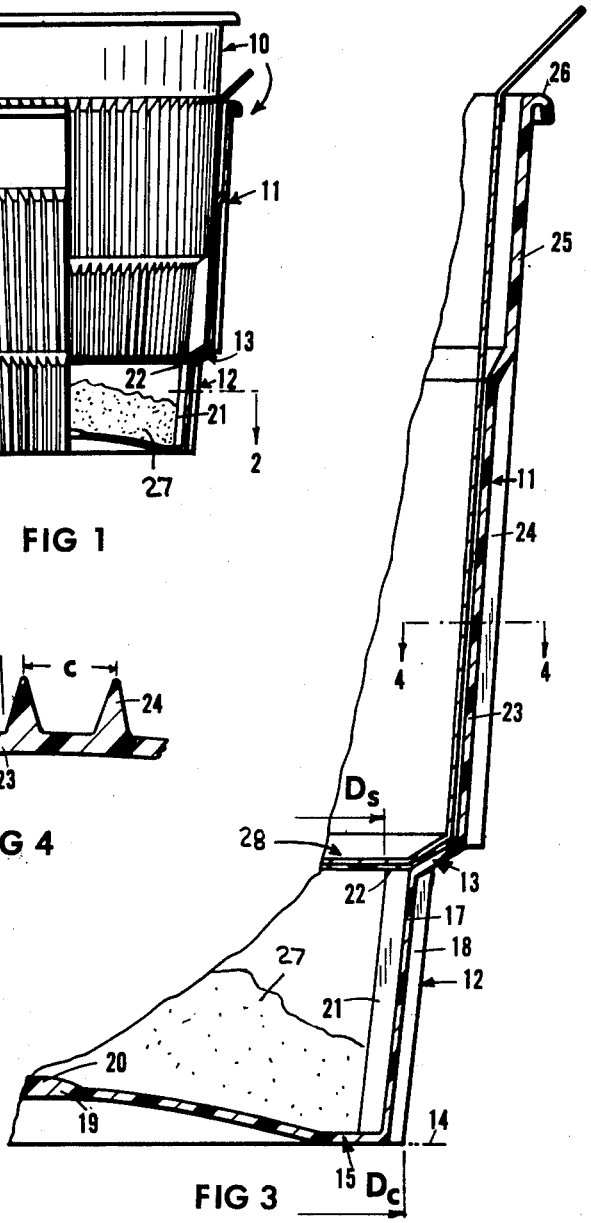
FIG. 3 is an enlarged sectional view of part of one of the cups shown in FIG. 1.

Referring back to FIG. 6, it will be noted that the circular portion 48 of the sealing cap is initially of plain circular form. During manufacture of the cup, the sealing cap is placed inside the cup body so that the peripheral margin of the inner layer 42 of circular portion 48 is disposed in contact with the annular flange 13' of the cup. At this time, the pull-tab 50 extends up the inner surface of the side wall 23' of the upper portion 11' of the cup generally as shown in connection with the preceding embodiment (FIG. 3). The sealing cap 40 is then heat sealed to the annular flane 13' by a conventional heat sealing tool having a heated annular face of a shape and size generally corresponding to the upper surface of flange 13'. The heat sealing tool is applied to the sealing cap for a time and at a temperature sufficient to cause the inner plastic layer 42 of the sealing cap to fuse with the annular flange 13' of the cap and thereby hermetically seal the beverage ingredient 27' in the lower portion 12' of the cup body.

As was described in connection with the preceding embodiment, a plurality of inwardly directed lugs 21' are provided on the side wall 17' of the lower portion 12' of the cup body. In this case, four lugs 21' are provided; each lug is of downwardly tapered shape. The lugs 21' define upper end faces 22' disposed generally even with the annular upper edge of side wall 17' and therefore immediately below the upper end faces 22' of the lugs 21'. Accordingly, when a second similar beverage cup such as that indicated in chain dotted outline at 52 in FIG. 7, is stacked inside the cup shown in that view, the lugs 21' support the cup 52 through the intermediary of the cap and thereby prevent excessive inward displacement of the cup 52, with consequent risk of penetration of the hermetic seal for the beverage ingredient 27', by dislodgement of the sealing cap or damage thereto.

FIG. 8 illustrates how the sealing cap 40 may be removed when water is to be added to the beverage ingredient 27'. A pull exerted on the tab 50 generally in the direction of arrow 54 will cause the circular portion 48 of the sealing cap to progressively peel off the annular flange 13' of the cup, exposing the ingredient in the lower portion of the cup. If the operation of heat sealing the sealing cap to the flange 13' was properly controlled as well known in the art, the sealing cap will separate cleanly from flange 13' without leaving any significant plastic residue on the flange.

It will of course be appreciated that the preceding description applies to specific embodiments only and that many modifications are possible within the broad scope of the invention. For example, the cup 10 is preferably injection molded from a suitable polystyrene material as indicated above. However, it is to be understood that the cup could be manufactured in other ways, eg. by blow molding or in other materials as well known in the art. Also, it should be noted that any suitable beverage ingredient may be contained in the cup, eg. soup mixes, instant coffee, and tea.

The sealing cap may also take other forms provided that the cap is capable of making a seal which is at least substantially air and moisture tight. The degree of air and moisture tightness depends on the intended use of the beverage package cup. For example, where the cup is required to have a relatively short shelf life, the seal need not be as efficient as where a long shelf life is required. In one example, the sealing cap could even by designed to dissolve when hot liquid is poured into the cup body. For example, a gelatin type sealing cap could be designed to meet this criterion. The sealing cap described with reference to FIGS. 6 to 8 includes an inner layer or film of a plastic material which is heat sealed to the cup body. In other embodiments, alternative materials may be used to form the heat seal with the cup body as well known in the art.

What I claim is:

1. A beverage package cup comprising:

a disposable drinking cup body having upper and lower portions of frusto-conical shape, and an outwardly directed annular flange disposed between and connecting said upper and lower portions, said lower portion including a base and an upwardly-divergent side wall, said annular flange being inclined upwardly from said lower portion to said upper portion and defining an annular upper edge with said lower portion, and said upper portion including an upwardly-divergent side wall;

a dry beverage ingredient disposed in said lower portion of the cup body; and, a removable cap hermetically sealing the beverage ingredient in said lower portion of the cup body, the cap comprising: a closure portion which is flexible and at least substantially impervious to moisture, and having its peripheral margin hermetically sealed to said annular flange of the cup body and extending across said lower portion of the cup so as to protect the beverage ingredient from deterioration due to contact with ambient air and moisture; and a pull-tab accessible from within the said upper portion of the cup body and arranged so that the cap can be detached from said annular flange by pulling on said tab;

said lower portion of the cup body additionally including a plurality of inwardly directed lugs disposed at spaced positions around the side wall of the lower cup body portion and each defining an upper end face disposed generally even with said annular upper edge of said lower portion and immediately below said cap so that, when a second similar cap is stacked inside the first, said lugs support the second cup through the intermediary of said cap and thereby prevent excessive inward displacement of the second cup and penetration of the hermetic seal by dislodgement of the sealing cap.

2. A cup as claimed in claim 1, wherein said cap includes a layer of a plastic material disposed at an inner side of the cap and hermetically sealed to said annular flange of the cup body by a heat seal formed between said plastic layer and said annular flange.

3. A cup as claimed in claim 2, wherein said sealing cap is of laminated form comprising said inner layer of said plastic material; an intermediate layer of aluminum foil; and an outer layer of paper, said layers being relatively thin whereby the cap has a flexible, non-rigid form.

4. A cup as claimed in claim 2, wherein said inner plastic layer of the sealing cap is a film of polyethylene and wherein said cup is made of a polystyrene material.

5. A beverage package cup comprising:

a disposable plastic drinking cup body having upper and lower portions of frusto-conical shape, and an outwardly directed annular flange disposed between and connecting said upper and lower portions, said lower portion including a base and an upwardly-divergent side wall, said annular flange being inclined upwardly from said lower portion to said upper portion and defining an annular upper edge with said lower portion, and said upper portion including an upwardly-divergent side wall;

a dry beverage ingredient disposed in said lower portion of the cup body; and, a removable cap hermetically sealing the beverage ingredient in said lower portion of the cup, the cap being in the form of a laminated structure having an inner layer of a polyethylene plastic material; an intermediate layer of aluminum foil; and an outer paper layer, said layers being relatively thin, whereby the cap is flexible and non-rigid; and the cap comprising: a closure portion having its peripheral margin heat sealed to said annular flange of the cup body and extending across said lower portion of the cup so as to protect the beverage ingredient from deterioration due to contact with ambient air and moisture; and a pull-tab accessible from within said upper portion of the cup body and arranged so that the cap can be detached from said annular flange by pulling on said tab;

said lower portion of the cup body additionally including a plurality of inwardly-directed lugs disposed at spaced positions around the side wall of the lower cup body portion and each defining an upper end face disposed generally even with said annular upper edge of said lower portion and immediately below said cap so that, when a second similar cup is stacked inside the first, said lugs support the second cup through the intermediary of the cap and thereby prevent excessive inward displacement of the second cup and penetration of the hermetic seal by dislodgement of the sealing cap.

* * * * *